US011745201B2

(12) United States Patent
Lochner et al.

(10) Patent No.: US 11,745,201 B2
(45) Date of Patent: Sep. 5, 2023

(54) SPRAY PLUME POSITION FEEDBACK FOR ROBOTIC MOTION TO OPTIMIZE COATING QUALITY, EFFICIENCY, AND REPEATABILITY

(75) Inventors: Christopher Joseph Lochner, Albany, NY (US); Joshua Lee Margolies, Niskayuna, NY (US); Jon E. Dickinson, Rotterdam, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/493,364

(22) Filed: Jun. 11, 2012

(65) Prior Publication Data

US 2013/0330466 A1 Dec. 12, 2013

(51) Int. Cl.

| | |
|---|---|
| ***B05B 12/00*** | (2018.01) |
| ***C23C 4/129*** | (2016.01) |
| ***B05D 7/20*** | (2006.01) |
| ***B05D 1/08*** | (2006.01) |
| ***B05B 12/08*** | (2006.01) |
| ***B05B 13/04*** | (2006.01) |
| *B05B 7/20* | (2006.01) |

(52) U.S. Cl.

CPC ..... *B05B 12/082* (2013.01); *B05B 13/0431* (2013.01); *C23C 4/129* (2016.01); *B05B 7/20* (2013.01); *B05D 1/08* (2013.01)

(58) Field of Classification Search

CPC ..... B05B 12/082; B05B 13/0431; B05B 7/20; B05D 1/08; C23C 4/121; C23C 4/124; C23C 4/127

USPC ..... 219/121.47–121.48; 427/422, 446, 427/449–456

See application file for complete search history.

(56) References Cited

U.S. PATENT DOCUMENTS 4,358,471 A 11/1982 Derkacs et al.
4,656,331 A * 4/1987 Lillquist ..... C23C 4/134 219/124.34

(Continued)

FOREIGN PATENT DOCUMENTS

EP 1340577 A2 9/2003
EP 1340577 A3 5/2004

(Continued)

OTHER PUBLICATIONS

European Search Report dated Mar. 8, 2017 regarding application No. 13171177.2.

*Primary Examiner* — Alexander M Weddle
(74) *Attorney, Agent, or Firm* — James Pemrick; Charlotte Wilson; Hoffman Warnick LLC

(57) ABSTRACT

A thermal spray system may include a thermal spray torch configured to produce an emission of material, at least one camera configured to capture an image of the emission of material emitted by the thermal spray torch, a diagnostic device communicatively coupled to the at least one camera, and a controller communicatively coupled to the diagnostic device. The camera may be configured to transmit an image of the emission of material to a diagnostic device that may be configured to determine a characteristic of the emission of material based on the image. The diagnostic device may transmit the characteristic to a controller that may control a position of the thermal spray torch based on the characteristic.

5 Claims, 3 Drawing Sheets

(56) References Cited

U.S. PATENT DOCUMENTS

| | | | | |
|---|---|---|---|---|
| 5,047,612 | A * | 9/1991 | Savkar | H05H 1/42 219/76.16 |
| 5,423,520 | A | 6/1995 | Anderson et al. | |
| 6,537,605 | B1 | 3/2003 | Kirchner et al. | |
| 6,640,878 | B2 | 11/2003 | Allor et al. | |
| 6,841,005 | B2 | 1/2005 | Schutte | |
| 7,020,539 | B1 * | 3/2006 | Kovacevic | B22F 10/66 700/98 |
| 7,043,069 | B1 | 5/2006 | Heinrich et al. | |
| 7,323,061 | B2 | 1/2008 | Vardelle et al. | |
| 2002/0017508 | A1 * | 2/2002 | Siniaguine | 219/121.59 |
| 2004/0031776 | A1 * | 2/2004 | Gevelber et al. | 219/121.36 |
| 2004/0245343 | A1 | 12/2004 | Srinivasan | |
| 2004/0245354 | A1 | 12/2004 | Srinivasan | |
| 2006/0201917 | A1 | 9/2006 | Bohmisch et al. | |
| 2006/0246213 | A1 * | 11/2006 | Moreau et al. | 427/8 |
| 2007/0281074 | A1 | 12/2007 | Wang et al. | |
| 2008/0166489 | A1 * | 7/2008 | Strock et al. | 427/421.1 |
| 2010/0110451 | A1 | 5/2010 | Biswas et al. | |

FOREIGN PATENT DOCUMENTS

| | | | | |
|---|---|---|---|---|
| EP | 2131144 | A1 | | 12/2009 |
| EP | 2674225 | B1 | | 5/2018 |
| JP | 2003027207 | A | | 1/2003 |
| JP | 2003522289 | A | | 7/2003 |
| JP | 2004002966 | A | | 1/2004 |
| JP | 2005525464 | A | | 8/2005 |
| JP | 2010111932 | A | | 5/2010 |
| JP | 2011235347 | A | * | 11/2011 |
| WO | 0031313 | A1 | | 6/2000 |

* cited by examiner

SPRAY PLUME POSITION FEEDBACK FOR ROBOTIC MOTION TO OPTIMIZE COATING QUALITY, EFFICIENCY, AND REPEATABILITY

TECHNICAL FIELD

The present disclosure relates to coatings and in particular to methods and systems for using a combination of application techniques to apply coatings to articles.

BACKGROUND

Gas turbines, which may also be referred to as combustion turbines, are internal combustion engines that accelerate gases, forcing the gases into a combustion chamber where heat is added to increase the volume of the gases. The expanded gases are then directed towards a turbine to extract the energy generated by the expanded gases. Gas turbines have many practical applications, including use as jet engines and in industrial power generation systems.

The accelerating and directing of gases within a gas turbine are often accomplished using rotating blades. Extraction of energy is typically accomplished by forcing expanded gases from the combustion chamber towards gas turbine blades that are spun by the force of the expanded gases exiting the gas turbine through the turbine blades. Due to the high temperatures of the exiting gases, gas turbine blades must be constructed to endure extreme operating conditions. While gas turbine blades are commonly constructed from metals, more advanced materials are now being used for such blades, such as ceramics and ceramic matrix composites. Ceramic matrix composites are also used to construct other components and articles that are likely to be subjected to extreme environmental conditions.

When using such advanced materials, or simply metal, in constructing items that may be subjected to extreme environmental conditions, coatings may be applied to provide added protection to the item and increase heat resistance and durability of such items. Such coatings are often applied using thermal spraying techniques. In thermal spraying, a liquid form of a material (typically created by melting a powder or solid prior to application) is sprayed onto the surface of the item. Often the thermal spraying process is performed automatically by systems designed to provide a consistent and controlled application of a coating.

Over time, the components of such systems may deteriorate, go out of alignment, or otherwise fail to meet the requirements for which they are configured. When several systems are installed in various sites, similar thermal spraying equipment may apply material in a variable manner due to variations in installation methods and/or conditions at each respective site, and therefore the application of material may not be consistent and may be outside of specifications in some sites despite the intended design. Moreover, while one or more components used to align a system may be in correct alignment and position, the resulting spray may not be applying material where it is intended to go. For example, a thermal spray torch may be correctly aligned such that a centerline of the torch is aligned with a particular point, but due to other equipment variations, such as internal components of the torch, the resulting spray may not be aligned with the centerline of the torch, and therefore material may not be applied to the correct area despite the apparent alignment of the torch.

When coatings are applied using components or processes that fail to meet their specified or desired requirements, manual reworking of the coated item may be required or the item may be put into use without detecting that it has not been properly coated by the thermal spray system. This problem is especially acute when coating three-dimensional items as proper positioning of a spray plume is especially important to provide the proper coating to all areas of such an item. Items such as gas turbine airfoils with complex geometries and varying surface features (e.g., inner radii, fillets, edges, etc.) require highly controlled thermal spray positioning so that specific coating requirements for each area of the item are met. For turbine components, and any thermal sprayed item in general, improperly applied coatings may result in higher costs, longer production times, and shorter lifespans for the coated items.

BRIEF DESCRIPTION OF THE INVENTION

A thermal spray system may include a thermal spray torch configured to produce an emission of material, at least one camera configured to capture an image of the emission of the material emitted by the thermal spray torch, a diagnostic device communicatively coupled to the at least one camera, and a controller communicatively coupled to the diagnostic device. The camera may be configured to transmit an image of the emission of the material to a diagnostic device that may be configured to determine a characteristic of the emission of the material based on the image. The diagnostic device may transmit the characteristic to a controller that may control a position of the thermal spray torch based on the characteristic.

A method is disclosed for operating a thermal spray system by producing an emission of material toward a surface with a thermal spray, capturing an image of the emission of the material, determining a characteristic of the emission of the material based on the image, and adjusting a position of the thermal spray torch based on the characteristic.

A method is disclosed for operating a thermal spray system by producing an emission of material toward a surface with a thermal spray torch, capturing an image of the emission of the material, and determining a center point of the emission of the material based on the image. A correct center point of emission may be determined, and the thermal spray torch may be adjusted based on the center point of emission such that a center point of emission of material is aligned with the correct center point of deposition.

The foregoing summary, as well as the following detailed description, is better understood when read in conjunction with the drawings. For the purpose of illustrating the claimed subject matter, there is shown in the drawings examples that illustrate various embodiments; however, the invention is not limited to the specific systems and methods disclosed.

BRIEF DESCRIPTION OF THE DRAWINGS

These and other features, aspects, and advantages of the present subject matter will become better understood when the following detailed description is read with reference to the accompanying drawings, wherein.

DETAILED DESCRIPTION OF THE INVENTION

In an embodiment, a coating, such as one or more layers of an environmental barrier coating (EBC), may be applied to an article using a thermal spray system. The article may be any article, including, but not limited to, a gas turbine blade, and the article may be constructed from any material, including, but not limited to, a ceramic matrix composite (CMC) and a Ni/Fe/Co based alloys. While the present disclosure may be described for exemplary purposes in terms of EBC application and various aspects thereof, the present disclosure is not limited to EBC, but may also apply to any coating that may be applied by thermal spray, such as, but not limited to, thermal barrier coatings, wear and corrosion protection coatings.

Figure 1:
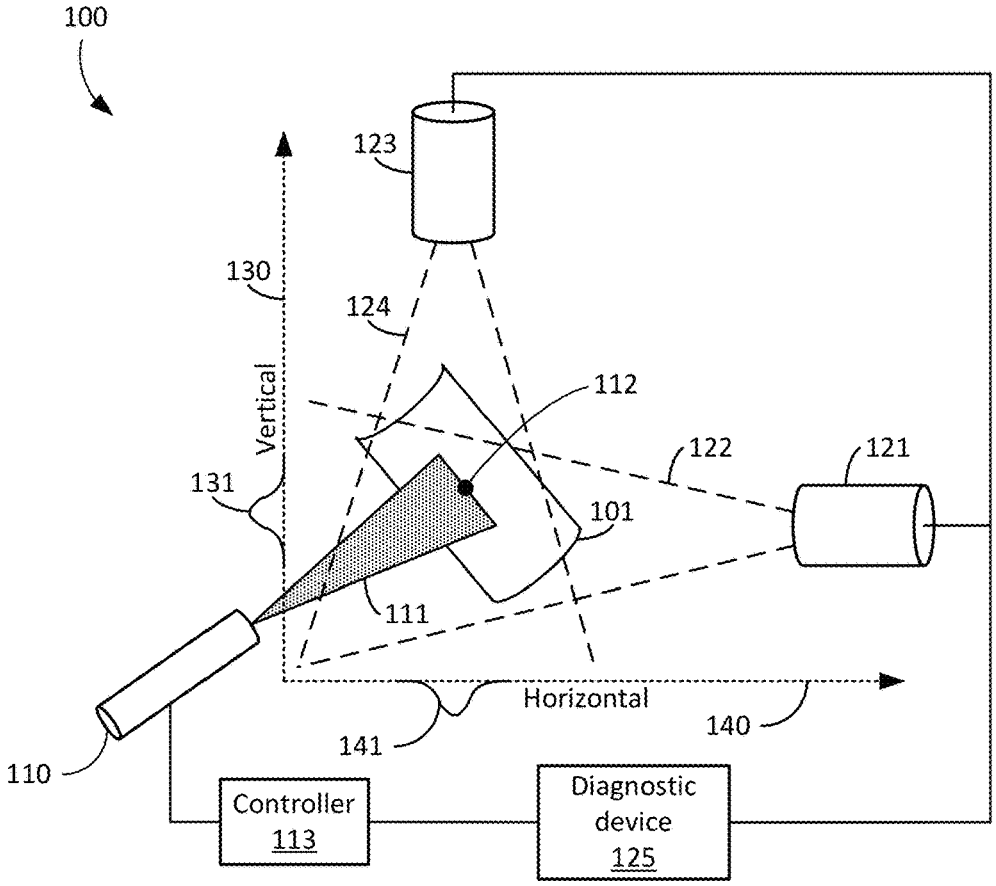
FIG. 1 is a block diagram of a non-limiting exemplary thermal spray system.

In an embodiment, process monitoring equipment may be integrated into a thermal spray system so that a spray plume position may be identified and characterized. Spray plume position data may be fed back into a robotic coating motion controller to align the plume with the item to be coated. FIG. 1 illustrates non-limiting, exemplary thermal spray system 100 that may include process monitoring equipment. Note that system 100 is a simplified system showing only the components and subsystems that are helpful in explaining embodiments described herein. Other components, devices, and subsystems may be included in any system that implements any of the embodiments described herein, and all such systems are contemplated as within the scope of the present disclosure.

Item 101 may be an item to be coated or being coated by system 100. Note that in any of the embodiments disclosed herein where thermal spray plumes, emissions by thermal spray torches, and/or any resulting depositions are analyzed or a thermal spray system is operated in accordance to an embodiment, such embodiments may be implemented and used with or without an item configured in the system for coating application. In FIG. 1, item 101 is shown to demonstrate how an item may be configured in a system such as system 101.

System 100 may be configured with thermal spray torch 110 that may be a thermal spray system component that heats and/or melts the material to be sprayed onto an item such as item 101. Thermal spray torch 110, and any thermal spray torch to which reference is made herein, may include components that may assist such a torch in moving, positioning, and/or otherwise depositing or emitting material onto a specific area of a surface of an item or a specific area of a thermal spray system. The motion and position of thermal spray torch 110 may be controlled, robotically or otherwise, by controller 113. Controller 113 may be any device, system, component, or any combination thereof capable of controlling the movement and position of torch 110. In an embodiment, controller 113 may be configured with one or more computer processors, memory devices, data storage devices, and input/output devices.

Figure 2:
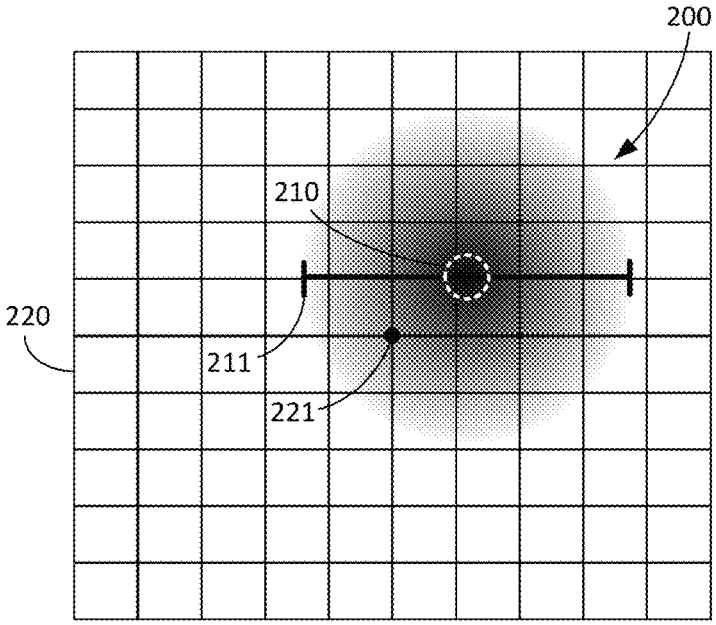
FIG. 2 is a non-limiting example of emitted material and characteristics thereof.

Thermal spray torch 110 may emit plume 111 of material, which may be an emission of any type of material. Plume 111 may have a plume center 112. Plume center 112 may be the most central point of the material emitted by thermal spray torch 110, and therefore may indicate the center point of a deposition applied by thermal spray torch 110. For example, referring now to FIG. 2, emitted or applied material 200 may have been emitted by a torch or deposited onto a surface of an item via a plume emitted by a torch, such as plume 111 emitted by torch 110, and center 210 may be the center of an emitted plume or center of the material applied by the center of an emitted plume, such as plume center 112.

Referring again to FIG. 1, system 100 may include process monitoring equipment that may be used to characterize a thermal spray plume and/or the resulting deposition of material in order to correctly align the components of system 100. Such equipment may include cameras such as cameras 121 and 123. Cameras 121 and 123 may be any type of cameras, including line scan cameras. Camera 121 may be configured to scan or otherwise obtain one or more images within area 122 while camera 123 may be configured to scan or otherwise obtain one or more images within area 124. For example, as shown in FIG. 1, camera 121 may be configured to scan a deposition area vertically (e.g., along vertical axis 130) to capture an image of the material being emitted from torch 110 and/or the material as deposited by torch 110, while camera 123 may be configured to scan a deposition area horizontally (e.g., along horizontal axis 140) to capture an image of the material being emitted from torch 110 and/or the material as deposited by torch 110. In this way, a complete image of a deposition area and any deposition therein may be obtained. Areas 122 and 124 may coincide or overlap, and may be the same area in space but viewed from two perpendicular angles (e.g., horizontal and vertical).

Note that each of cameras 121 and 123 may be configured with filters or other components that assist in the camera's operation in a thermal spray system. For example, cameras 121 and 123 may be fitted with infrared filters to reduce or filter out infrared light wavelengths. This may improve performance in a thermal spraying environment because thermal spraying processes may involve high temperatures that make image capture more difficult without such filters. Any other filters or components may also, or instead, be used with such cameras, and such cameras may have no filters or additional components configured. All such embodiments are contemplated as within the scope of the present disclosure.

Within the area for which cameras 121 and 123 are configured to scan may be a point of deposition of material sprayed by torch 110 and deposited via plume 111. The scanned images obtained by cameras 121 and 123 may be transmitted to diagnostic device 125. Diagnostic device 125 may process and/or analyze these images to characterize the emission and/or deposition of material. For example, diagnostic device 125 may determine the size, position, center, shape, and any other characteristics of an emission of material as it is emitted from torch 110 or a deposition of material as it is deposited by torch 110 onto a surface. This may be done using any method, means, or algorithm. For example, diagnostic device 125 may determine the most dense area of material vertically within an emission of material by torch 110 or a line of heaviest deposition vertically (represented by arc 131 and determined from image(s) taken by line scan camera 121) and may determine the most dense area of material horizontally within an emission of material by torch 110 or a line of heaviest deposition horizontally (represented by arc 141 and determined from image(s) taken by line scan camera 123). Diagnostic device 125 may then determine that the intersection of these areas or lines is plume center 112, that is, the center point of an emission or a deposition when material is emitted by torch 110 and plume 111.

Upon determining the desired characteristic of plume 111 and/or the associated emission or resulting deposition, such as plume center 112 and/or the center point of a deposition when material is emitted by torch 110, coordinates of such a characteristic, or other data relating to the determined characteristics, may be transmitted to controller 113 by diagnostic device 125. Controller 113 may then use these coordinates and/or any other data received from diagnostic device 125 to adjust the position and motion of torch 110. For example, controller 113 may operate using an algorithm, such as a coating motion program, that accepts variables that represent the coordinates of a current detected position of a center point of a deposition applied by torch 110. In an embodiment, the algorithm may be implemented by software executing on a processor. The coordinates of such a center point as determined and transmitted by diagnostic device 125 may be entered into this algorithm and the algorithm may then be used to determine and implement any adjustments needed to the position and motion of torch 110. Such an algorithm may also use data from a diagnostic device to determine a number of passes a torch should perform on a particular path of travel along which material may be emitted, the width and/or spacing of such paths, and/or any other parameters of an automated spraying process or an algorithm or computer-executable program controlling an automated spraying process.

Referring again to FIG. 2, emitted or applied material 200 may be analyzed by a diagnostic device such as diagnostic device 125. Note that emitted or applied material 200 may be actual emitted material or actual applied material or a representation of emitted or applied material as detected by one or more cameras and/or resulting from processing of images detected by one or more cameras such as cameras 121 and 123. A diagnostic device may analyze emitted or applied material 200 to determine characteristic of the emission or deposition of emitted or applied material 200. Such characteristics may be presented in terms of coordinates and other data that may be presented relative to coordinate system 220. Coordinate system 220 may be a coordinate system that is used for positioning and moving a thermal spray torch. Coordinate system 220 may be physically configured on a thermal spray system or may be a virtual coordinate system that is used internally by devices and components of a thermal spray system. In an embodiment, one or more lasers may emit a beam into an area that is used for capturing diagnostic images, and the position of such beams may provide a point from which coordinate system 220 may be determined by a diagnostic system. In another embodiment, any other type of fiducial marker may be emitted, applied, or otherwise present in such a system and used to provide a point of reference for determining coordinate system 220. Alternatively, or in addition, any data generated by a diagnostic system, such as center point coordinates, may be relative to a detected laser beam or fiducial marker in a thermal spray system. All such embodiments are contemplated as within the scope of the present disclosure.

In an embodiment, a diagnostic device may determine coordinates for center 210 of emitted or applied material 200 on coordinate system 220. These coordinates may be communicated to a robotic controller of a torch, or to any other device, component, or combination thereof, that controls the motion and position of a thermal spray torch. A controller may then compare the coordinates for center 210 to the coordinates for the correct position for a center of a material emission/deposition, and adjust the position of a torch accordingly. For example, correct center 221 may be the correct center point for material emitted or applied via a thermal spray torch plume. A controller may adjust the position of a torch such that upon the next application of material, center 210 is aligned with correct center 221. In an embodiment where one or more laser beams are used to determine a coordinate system or otherwise determine coordinates for a deposition characteristic, a controller may also determine the location of the beam and use that location data in combination with the characteristic data to perform adjustments. Note that a diagnostic device may perform the determination of the degree of accuracy of a thermal spray torch plume and may transmit the needed adjustments to a controller. Alternatively, all such functions may be combined into a single device or component, or may be distributed among devices and/or components in order to achieve the same result of aligning a torch. All such embodiments are contemplated as within the scope of the present disclosure.

Other characteristics of emitted or applied material 200 may be determined and used for adjusting a torch. For example, width 211 of emitted or applied material 200 may be determined, and a controller may adjust the spray width as needed to comply with a specified width. Similarly, a shape, size, and/or any other characteristic of emitted or applied material 200 may be determined and used to determine adjustments for a thermal spray system. Note also that any parameters of an automated spraying process may be adjusted using data generated by a diagnostic device. For example, data from a diagnostic device may be used to determine a number of passes a torch should perform on a particular path of travel along which material may be emitted, the width of such paths, and/or any other parameters of an automated spraying process. All such embodiments are contemplated as within the scope of the present disclosure.

Figure 3:
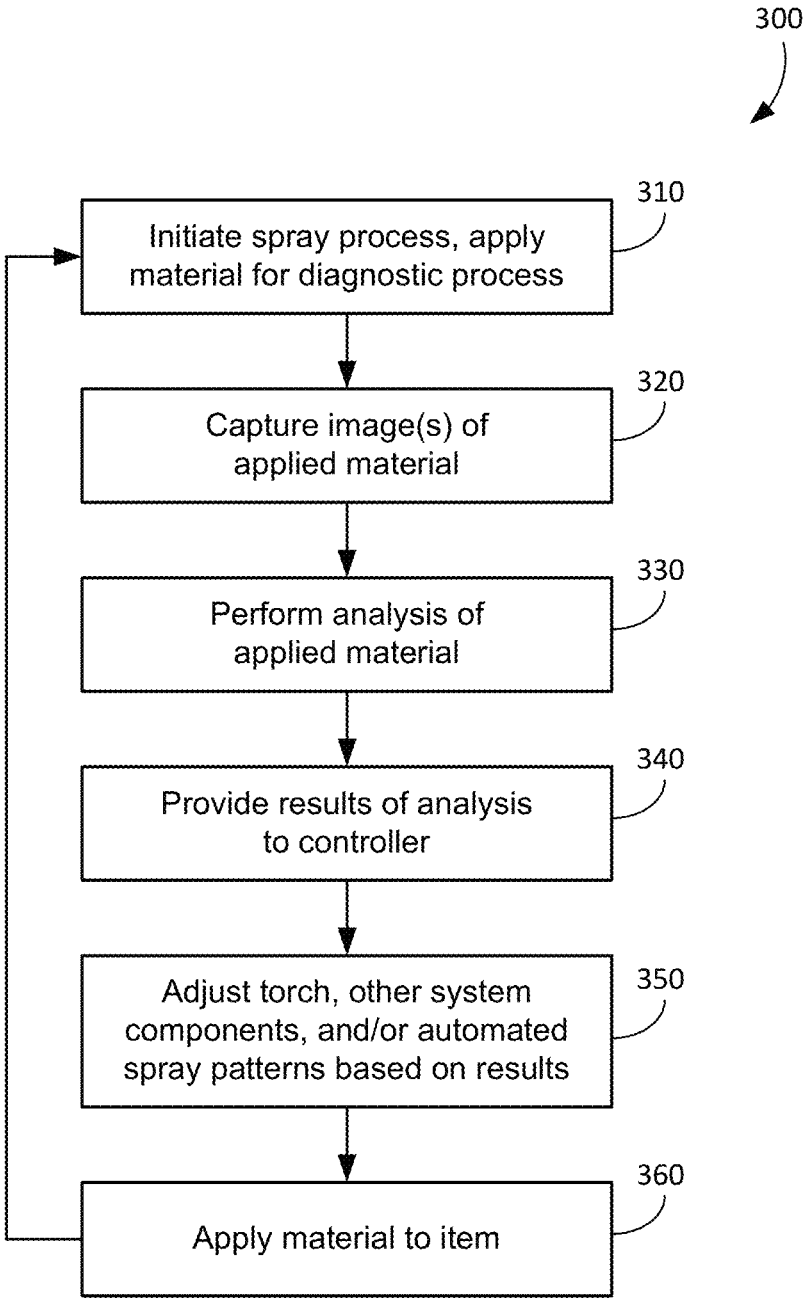
FIG. 3 is a non-limiting exemplary method of implemented an embodiment according to the present disclosure.

FIG. 3 illustrates non-limiting exemplary method 300 of implementing an embodiment according to the present disclosure. At block 310, a spray process may be initiated and material may be applied for diagnostic purposes. The applied material may be applied to a diagnostic surface, such as an area in or proximate to a thermal spray system that is intended for diagnostic material deposition so that a deposit is not applied to an item that is intended to be the end product of the thermal spaying process. Alternatively, the applied material may be applied directly to an item that is ultimately going to be coated by the material.

At block 320, one or more images of the material applied for diagnostic purposes may be captured. As noted herein, such images may be captured by one or more cameras configured at a thermal spray system. In an embodiment, images captured may be of the particles of material in-flight as they are emitted from a thermal spray torch. Alternatively, the images may be of the deposit made by the deposition of material onto a diagnostic surface or an item. At block 330, such images may be analyzed and the material applied or emitted may be characterized. As noted herein, such analysis may determine a center point of material emission/deposition and/or a size, shape, and/or position of the material emission or deposition. Such characterization data may be provided in a form that refers to a common coordinate system used among devices and/or components of the thermal spray system. In some embodiments, characterization data may also include adjustments to be made by a controller, while in other embodiments, characterization data may only include data regarding the present characteristics of the applied or emitted material, allowing the controller to determine the necessary adjustments. In some embodiments, at block 330 a determination of a coordinate system or a point of reference may also be determined to facilitate the determination of characterization data. For example, images supplied by the cameras may also capture a laser beam or other fiducial marker that may be used as a point of reference for determining a coordinate system and/or a relative location of a characteristic of the material emitted and/or applied. All such embodiments are contemplated as within the scope of the present disclosure.

At block 340, the results of such analysis may be provided to a controller that controls the movement and/or position of a thermal spray torch. As noted above, the controller may determine the necessary adjustments or the necessary adjustments may be provided to the controller with, or in place of, the data. At block 350 any adjustments to any components of the thermal spray system may be made. This may include adjusting the position of a torch, the spray patterns to be followed by the torch, a number of passes a torch should perform on any particular path of motion along which material may be emitted, the width and/or spacing of such paths, and/or any other parameters of an automated spraying process. Any adjustment of any component, device, hardware, software, and any combination thereof may be made using the results of analysis such as that performed at block 330 is contemplated as within the scope of the present disclosure.

At block 360, the thermal spray process for coating an item may commence following the adjustment of components to ensure that proper alignment is present. Following the coating of a single item or a set of items, method 300 may return to block 310 and the alignment correction process may be performed again before another item or set of items is sprayed. By ensuring correct alignment and positioning of thermal spray equipment between each item coating, errors in applying the coating may be minimized and consistency among items that have been coated may be improved. Alternatively, the alignment correction processes disclosed herein may be performed periodically or at the instruction of an operator of a system.

The technical effect of the systems and methods set forth herein is the alignment and positioning of thermal spray system components so that accurate and precise application of thermally sprayed material may be effected. As will be appreciated by those skilled in the art, the use of process monitoring equipment in, or in combination with, a thermal spray system may reduce or eliminate improper application of material to items thereby reducing or eliminating the need to rework such items and improve the performance and longevity of such items and/or coatings applied thereto.

Figure 4:
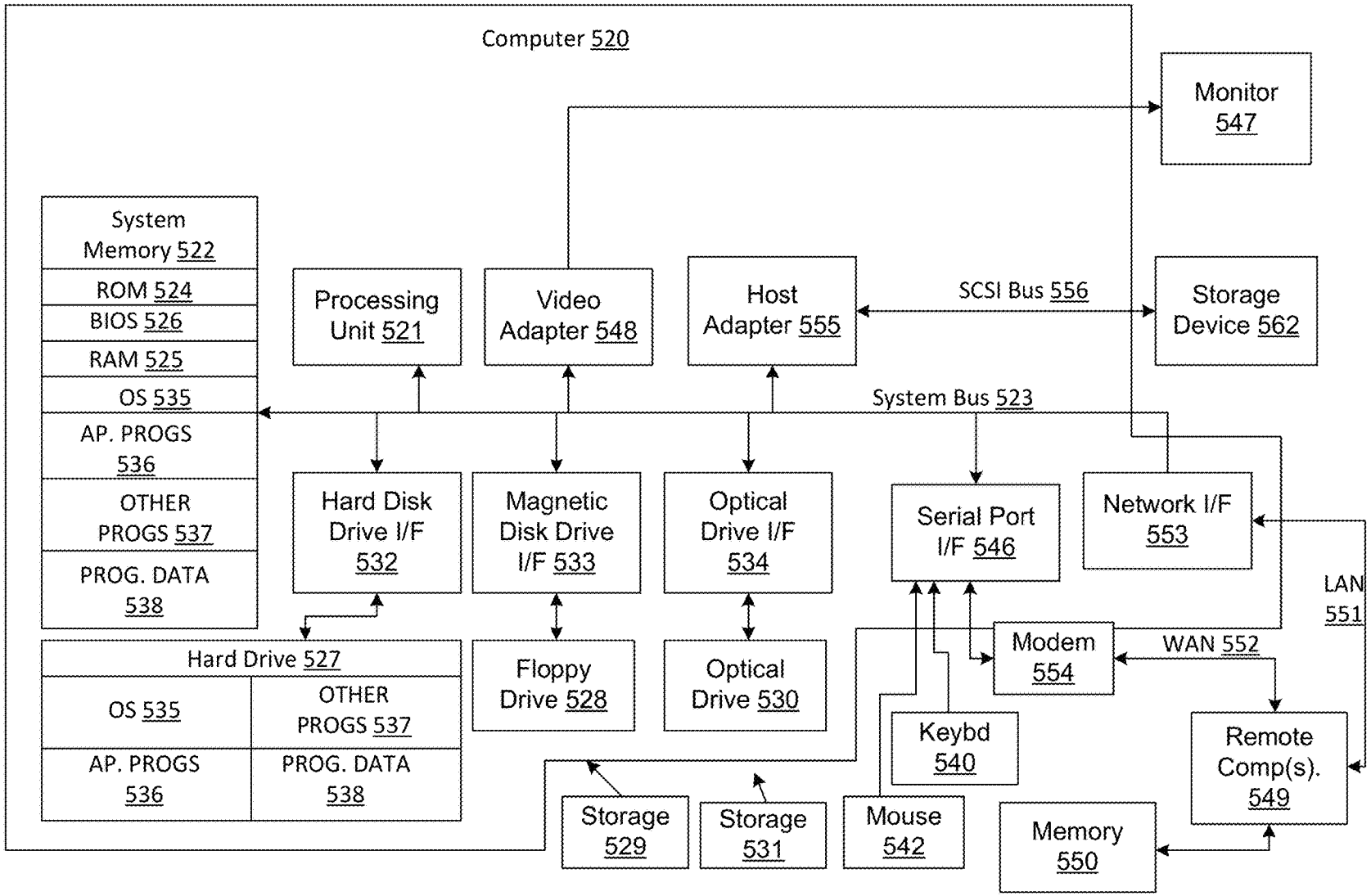
FIG. 4 is an exemplary block diagram representing a general purpose computer system in which aspects of the methods and systems disclosed herein may be incorporated.

FIG. 4 and the following discussion are intended to provide a brief general description of a suitable computing environment in which the methods and systems disclosed herein and/or portions thereof may be implemented. Although not required, the methods and systems disclosed herein may be described in the general context of computer-executable instructions, such as program modules, being executed by a computer, such as a client workstation, server or personal computer. Generally, program modules include routines, programs, objects, components, data structures and the like that perform particular tasks or implement particular abstract data types. Moreover, it should be appreciated that the methods and systems disclosed herein and/or portions thereof may be practiced with other computer system configurations, including hand-held devices, multi-processor systems, microprocessor-based or programmable consumer electronics, network PCs, minicomputers, mainframe computers and the like. The methods and systems disclosed herein may also be practiced in distributed computing environments where tasks are performed by remote processing devices that are linked through a communications network. In a distributed computing environment, program modules may be located in both local and remote memory storage devices.

FIG. 4 is a block diagram representing a general purpose computer system in which aspects of the methods and systems disclosed herein and/or portions thereof may be incorporated. As shown, the exemplary general purpose computing system includes computer 520 or the like, including processing unit 521, system memory 522, and system bus 523 that couples various system components including the system memory to processing unit 521. System bus 523 may be any of several types of bus structures including a memory bus or memory controller, a peripheral bus, and a local bus using any of a variety of bus architectures. The system memory may include read-only memory (ROM) 524 and random access memory (RAM) 525. Basic input/output system 526 (BIOS), which may contain the basic routines that help to transfer information between elements within computer 520, such as during start-up, may be stored in ROM 524.

Computer 520 may further include hard disk drive 527 for reading from and writing to a hard disk (not shown), magnetic disk drive 528 for reading from or writing to removable magnetic disk 529, and optical disk drive 530 for reading from or writing to removable optical disk 531 such as a CD-ROM or other optical media. Hard disk drive 527, magnetic disk drive 528, and optical disk drive 530 may be connected to system bus 523 by hard disk drive interface 532, magnetic disk drive interface 533, and optical drive interface 534, respectively. The drives and their associated computer-readable media provide non-volatile storage of computer readable instructions, data structures, program modules and other data for computer 520.

Although the exemplary environment described herein employs a hard disk, removable magnetic disk 529, and removable optical disk 531, it should be appreciated that other types of computer readable media that can store data that is accessible by a computer may also be used in the exemplary operating environment. Such other types of media include, but are not limited to, a magnetic cassette, a flash memory card, a digital video or versatile disk, a Bernoulli cartridge, a random access memory (RAM), a read-only memory (ROM), and the like.

A number of program modules may be stored on hard disk drive 527, magnetic disk 529, optical disk 531, ROM 524, and/or RAM 525, including an operating system 535, one or more application programs 536, other program modules 537 and program data 538. A user may enter commands and information into the computer 520 through input devices such as a keyboard 540 and pointing device 542. Other input devices (not shown) may include a microphone, joystick, game pad, satellite disk, scanner, or the like. These and other input devices are often connected to the processing unit 521 through a serial port interface 546 that is coupled to the system bus, but may be connected by other interfaces, such as a parallel port, game port, or universal serial bus (USB). A monitor 547 or other type of display device may also be connected to the system bus 523 via an interface, such as a video adapter 548. In addition to the monitor 547, a computer may include other peripheral output devices (not shown), such as speakers and printers. The exemplary system of FIG. 4 may also include host adapter 555, Small Computer System Interface (SCSI) bus 556, and external storage device 562 that may be connected to the SCSI bus 556.

The computer 520 may operate in a networked environment using logical connections to one or more remote computers, such as remote computer 549. Remote computer 549 may be a personal computer, a server, a router, a network PC, a peer device or other common network node, and may include many or all of the elements described above relative to the computer 520, although only a memory storage device 550 has been illustrated in FIG. 4. The logical connections depicted in FIG. 4 may include local area network (LAN) 551 and wide area network (WAN) 552. Such networking environments are commonplace in offices, enterprise-wide computer networks, intranets, and the Internet.

When used in a LAN networking environment, computer 520 may be connected to LAN 551 through network interface or adapter 553. When used in a WAN networking environment, computer 520 may include modem 554 or other means for establishing communications over wide area network 552, such as the Internet. Modem 554, which may be internal or external, may be connected to system bus 523 via serial port interface 546. In a networked environment, program modules depicted relative to computer 520, or portions thereof, may be stored in a remote memory storage device. It will be appreciated that the network connections shown are exemplary and other means of establishing a communications link between computers may be used.

Computer 520 may include a variety of computer readable storage media. Computer readable storage media can be any available media that can be accessed by computer 520 and includes both volatile and nonvolatile media, removable and non-removable media. By way of example, and not limitation, computer readable media may comprise computer storage media and communication media. Computer storage media include both volatile and nonvolatile, removable and non-removable media implemented in any method or technology for storage of information such as computer readable instructions, data structures, program modules or other data. Computer storage media include, but are not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 520. Combinations of any of the above should also be included within the scope of computer readable media that may be used to store source code for implementing the methods and systems described herein. Any combination of the features or elements disclosed herein may be used in one or more embodiments.

This written description uses examples to disclose the subject matter contained herein, including the best mode, and also to enable any person skilled in the art to practice the invention, including making and using any devices or systems and performing any incorporated methods. The patentable scope of this disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a thermal spray system comprising:

producing an emission of material toward a surface with a thermal spray torch;

capturing an image of the emission of the material;

determining a characteristic of the emission of the material based on the image;

adjusting a position of the thermal spray torch based on the characteristic of the emission of the material;

capturing an image of the emission of the material comprises capturing a first image of the emission of the material via a first camera and capturing a second image of the emission of the material via a second camera, wherein the first camera includes an infrared filter for filtering out all infrared light wavelengths when capturing the first image, and wherein the second camera includes an infrared filter for filtering out all infrared light wavelengths when capturing the second image; and further emitting a laser beam onto the surface as a point of reference, where at least one of the first and second image of the emission of the material comprises an image of the laser beam.

2. The method of claim 1, wherein the image is captured by at least a line scan camera.

3. The method of claim 1, wherein the characteristic of the emission of the material comprises at least one of a center point of the emission of the material, a width of the emission of the material, a size of the emission of the material, or a shape of the emission of the material.

4. The method of claim 1, wherein determining the characteristic of the emission of the material comprises determining coordinates associated with the characteristic of the emission of the material.

5. The method of claim 1, wherein the characteristic of the emission of the material is a center point of the emission of the material, and wherein adjusting the position of the thermal spray torch based on the characteristic of the emission of the material comprises adjusting the thermal spray torch such that the center point of emission of the material is changed to a predetermined center point of the emission.

* * * * *